US010787300B2

(12) United States Patent
Adams et al.

(10) Patent No.: US 10,787,300 B2
(45) Date of Patent: Sep. 29, 2020

(54) LIQUID CARRIER AND DISPENSER

(71) Applicant: Smurfit Kappa North America LLC, Washington, DC (US)

(72) Inventors: Pamela Gayle Adams, Long Beach, CA (US); Charles H. M. Andureu, Playa del Rey, CA (US)

(73) Assignee: Smurfit Kappa North America LLC, Irving, TX (US)

( * ) Notice: Subject to any disclaimer, the term of this patent is extended or adjusted under 35 U.S.C. 154(b) by 0 days.

(21) Appl. No.: 16/158,862

(22) Filed: Oct. 12, 2018

(65) Prior Publication Data

US 2020/0115131 A1 Apr. 16, 2020

(51) Int. Cl.

| | |
|---|---|
| ***B65D 77/06*** | (2006.01) |
| ***B65D 5/74*** | (2006.01) |
| ***B65D 5/40*** | (2006.01) |
| *B65D 5/20* | (2006.01) |
| *B67D 1/08* | (2006.01) |
| *B65D 5/42* | (2006.01) |
| *B65D 5/46* | (2006.01) |
| *B67D 3/00* | (2006.01) |

(52) U.S. Cl.

CPC ..... *B65D 77/067* (2013.01); *B65D 5/40* (2013.01); *B65D 5/746* (2013.01); *B65D 5/2047* (2013.01); *B65D 5/2057* (2013.01); *B65D 5/4208* (2013.01); *B65D 5/4266* (2013.01); *B65D 5/46104* (2013.01); *B67D 3/0067* (2013.01); *B67D 2001/0827* (2013.01)

(58) Field of Classification Search

CPC ..... B65D 77/067; B65D 5/40; B65D 5/46; B65D 5/746; B65D 5/46104; B65D 5/2047; B65D 5/4208; B65D 5/4266; B65D 5/2057; B67D 3/0067; B67D 2001/0827

USPC ..... 222/105, 106, 183; 229/117.13–117.15, 229/117.3, 117.35, 117.27, 117.12, 229/117.09, 117.14, 117.31, 117.32

See application file for complete search history.

(56) References Cited

U.S. PATENT DOCUMENTS

| | | | |
|---|---|---|---|
| 4,796,788 | A | 1/1989 | Bond |
| 5,715,992 | A | 2/1998 | Andrews, Sr. et al. |

(Continued)

FOREIGN PATENT DOCUMENTS

| | | | |
|---|---|---|---|
| GB | 2172663 | A | 9/1986 |
| HK | 1016944 | A1 | 9/2002 |
| TW | 200500198 | A | 1/2005 |

OTHER PUBLICATIONS

PCT Notification of Transmittal of the International Search Report and the Written Opinion of the International Searching Authority, or the Declaration regarding PCT/US 2019/051221, dated Nov. 22, 2019.

(Continued)

*Primary Examiner* — Lien M Ngo

(74) *Attorney, Agent, or Firm* — Baker Botts L.L.P.

(57) ABSTRACT

In one embodiment, a liquid dispensing system includes a bag, a tap, and a box. The bag includes a spout that is configured to permit the bag to be filled with a liquid. The tap is configured to be coupled to the bag. The box is configured to hold the bag. The box includes a back side and a front side opposite the back side. The front side includes an aperture for the tap. At least a portion of the aperture is located below a horizontal center line of the front side.

19 Claims, 4 Drawing Sheets

(56) References Cited

U.S. PATENT DOCUMENTS

| | | | | |
|---|---|---|---|---|
| 5,826,752 | A * | 10/1998 | Latimer | B65D 5/5405 222/105 |
| 5,909,841 | A | 6/1999 | Andrews, Sr. et al. | |
| 6,062,431 | A * | 5/2000 | Geshay | B65D 5/4608 221/96 |
| 6,109,518 | A | 8/2000 | Mueller et al. | |
| 6,196,452 | B1 | 3/2001 | Andrews, Sr. et al. | |
| 6,253,993 | B1 * | 7/2001 | Lloyd | B65D 5/2047 229/112 |
| 6,736,289 | B2 | 5/2004 | Cook et al. | |
| 7,066,869 | B2 | 6/2006 | Cook et al. | |
| 7,150,377 | B2 | 12/2006 | Cook et al. | |
| 7,325,718 | B2 | 2/2008 | Cook et al. | |
| 7,587,883 | B2 | 9/2009 | Cook et al. | |
| 7,735,640 | B2 | 6/2010 | Cook et al. | |
| 7,740,139 | B2 | 6/2010 | Cook et al. | |
| 7,770,756 | B2 | 8/2010 | Cook et al. | |
| D625,600 | S * | 10/2010 | Hill | D9/431 |
| 8,015,780 | B2 | 9/2011 | Cook et al. | |
| 8,085,763 | B2 | 12/2011 | Niccolini et al. | |
| D674,690 | S * | 1/2013 | Sill | D9/431 |
| 8,529,723 | B2 | 9/2013 | Fu et al. | |
| D727,169 | S | 4/2015 | Pease | |
| 9,051,102 | B2 | 6/2015 | Cook et al. | |
| 9,056,712 | B2 | 6/2015 | Cook et al. | |
| 9,102,440 | B2 | 8/2015 | Cook et al. | |
| D772,054 | S | 11/2016 | Wolf | |
| 9,505,516 | B2 | 11/2016 | Hubbard, Jr. et al. | |
| 9,527,661 | B2 | 12/2016 | Fu et al. | |
| 9,629,494 | B2 | 4/2017 | Fu et al. | |
| 2006/0243783 | A1 * | 11/2006 | Spivey, Sr. | B65D 5/4208 229/117.3 |
| 2007/0039974 | A1 * | 2/2007 | Lloyd | A23G 9/045 222/105 |
| 2007/0145072 | A1 * | 6/2007 | Cook | B65D 77/065 222/105 |
| 2007/0228123 | A1 * | 10/2007 | McKenna | B65D 5/2076 229/117.13 |
| 2011/0253774 | A1 * | 10/2011 | Hill | B65D 5/46112 229/117.3 |
| 2011/0259916 | A1 | 10/2011 | Spivey, Sr. et al. | |
| 2014/0374447 | A1 | 12/2014 | Coogan et al. | |
| 2016/0251109 | A1 | 9/2016 | Wolf | |
| 2017/0210533 | A1 | 7/2017 | Couvillon et al. | |

OTHER PUBLICATIONS

Beverage On the Move® Catering Packaging—Bulk Beverage Box Packaging Suppliers & Manufacturers, http://www.lbpmfg.com/product/beverage-on-the-move/ (7 pages), Downloaded Oct. 12, 2018.
www.pbisales.com.
www.baristabox.com.

* cited by examiner

LIQUID CARRIER AND DISPENSER

TECHNICAL FIELD

This disclosure generally relates to packaging and more specifically to a liquid carrier and dispenser.

BACKGROUND

Many businesses offer carry-out and catering services to customers that include bulk quantities of beverages. For example, some coffee shops offer large containers of coffee that may be purchased and transported to serve groups of people at events such as conferences, meetings, parties, or any other group gathering. While certain packaging solutions for transporting and dispensing bulk quantities of liquid are currently available, they are typically awkward to use and repeatedly expose their liquid contents to air, thereby causing warm liquids to cool over time and cool liquids to become warm over time.

SUMMARY OF PARTICULAR EMBODIMENTS

According to one embodiment, a liquid dispensing system includes a collapsible bag, a tap, and a box. The collapsible bag is configured to be filled with a liquid. The collapsible bag includes a spout that is configured to permit the liquid to be poured into the collapsible bag. The tap is configured to be coupled to the collapsible bag and permits the liquid to be dispensed out of the collapsible bag. The box is configured to contain the collapsible bag. The box includes a back side, a front side opposite the back side, a left side, a right side opposite the left side, a bottom side, and a top side. The front side includes an access hole for the tap. At least a portion of the access hole is located below a horizontal center line of the front side. The top side is sloped from the back side towards the front side. The box further includes a handle configured for carrying the box. The handle is located proximate to the top side of the box. The box further includes a plurality of feet located on the bottom side of the box proximate to the back side. The plurality of feet are configured to elevate the back side of the box.

According to another embodiment, a liquid dispensing system includes a bag, a tap, and a box. The bag includes a spout that is configured to permit the bag to be filled with a liquid. The tap is configured to be coupled to the bag. The box is configured to hold the bag. The box includes a back side and a front side opposite the back side. The front side includes an aperture for the tap. At least a portion of the aperture is located below a horizontal center line of the front side.

According to another embodiment, a box for a liquid dispensing system includes a back side, a front side opposite the back side, a left side, a right side opposite the left side, a bottom side, and a top side opposite the bottom side. The front side includes an access hole for a tap, at least a portion of the access hole being located below a horizontal center line of the front side. The top side is sloped from the back side towards the front side. The top side is configured to open and close in order to permit a bag to be placed into the box. The bag is configured to carry a liquid. The box further includes a handle configured for carrying the box. The handle is located proximate to the top side of the box. The box further includes a plurality of feet located on the bottom side of the box proximate to the back side. The plurality of feet are configured to elevate the back side of the box.

Technical advantages of certain embodiments may include providing a liquid carrier and dispensing system that is inexpensive, quick to assemble, easy to use, and is at least partially recyclable. In some embodiments, the liquid carrier and dispensing system is configured in such a way that a user is not required to lift and tilt the system in order to dispense liquid into a cup. Instead, some embodiments provide a specially-shaped dispenser that includes a tap that is located on the dispenser in a way that permits liquid to be easily dispensed simply by operating the tap. Furthermore, unlike other liquid dispensing systems, users do not have to manually remove a cap in order to dispense liquid. This prevents exposing liquid contents to air and therefore helps keep warm liquids such as coffee warmer and fresher longer.

Other technical advantages will be readily apparent to one skilled in the art from the following figures, descriptions, and claims. Moreover, while specific advantages have been enumerated above, various embodiments may include all, some, or none of the enumerated advantages.

DESCRIPTION OF EXAMPLE EMBODIMENTS

Many businesses offer carry-out and catering services to customers that include bulk quantities of beverages. For example, some coffee shops offer large containers of coffee that may be purchased and transported to serve groups of people at events such as conferences, meetings, parties, or any other group gathering. While certain packaging solutions for transporting and dispensing bulk quantities of liquid are currently available, they are typically awkward to use and repeatedly expose their liquid contents to air, thereby causing warm liquids to cool over time and cool liquids to become warm over time.

To address these and other problems with existing products for transporting bulk quantities of liquid, the teachings of the disclosure provide a liquid carrier and dispensing system that is inexpensive, quick to assemble, easy to use, and is at least partially recyclable. In some embodiments, the liquid carrier and dispensing system is configured in such a way that a user is not required to lift and tilt the system in order to dispense liquid into a cup. Furthermore, unlike other liquid dispensing systems, some embodiments are completely sealed after being filled with liquid and do not have to be unsealed in order to dispense the liquid. This prevents exposing liquid contents to air and therefore helps keep warm liquids such as coffee warmer and fresher longer. The following describes a liquid carrier and dispensing system that provides these and other advantages.

Figure 1A:
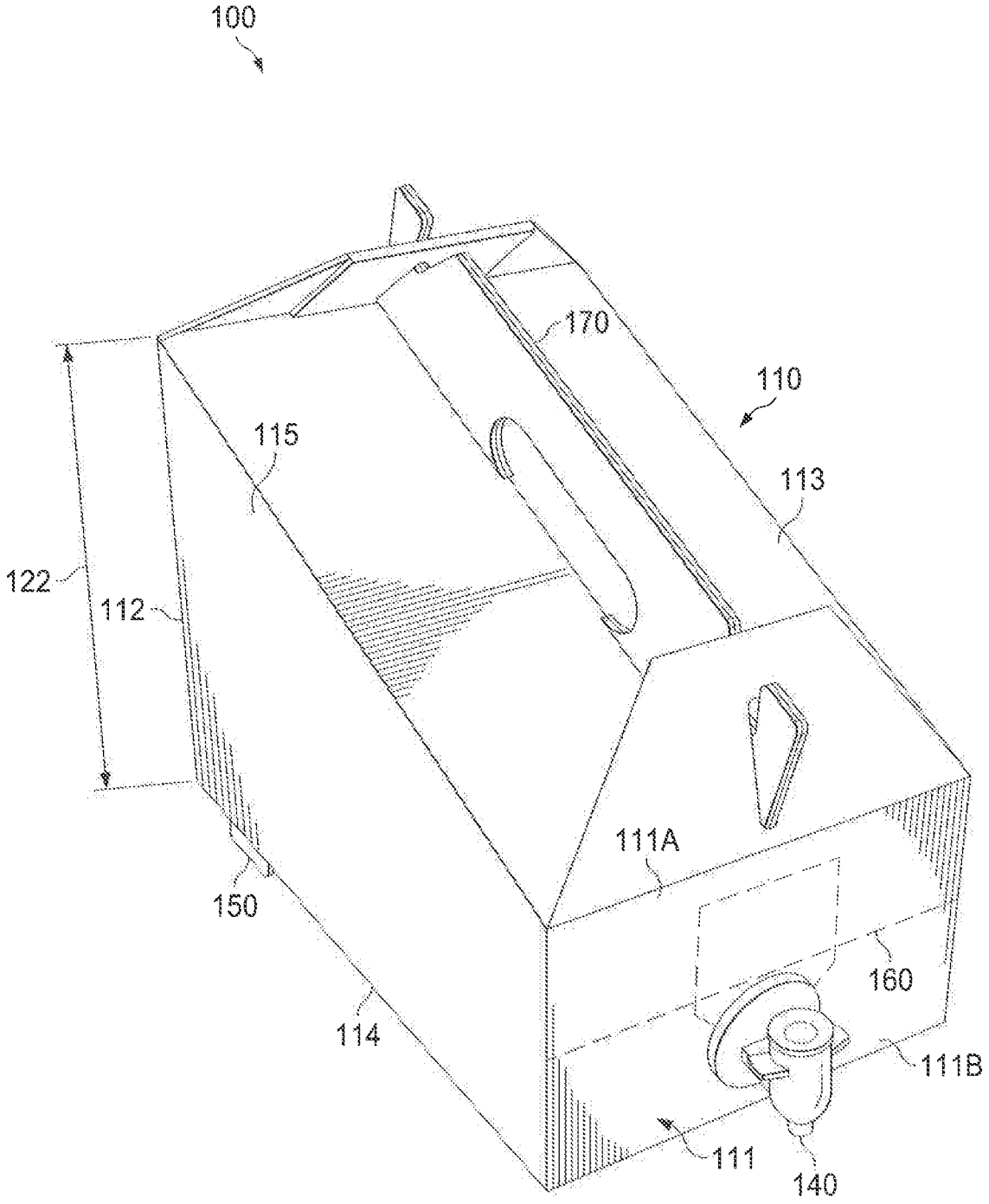
FIGS. 1A and 1B illustrate a liquid carrier and dispensing system, according to certain embodiments.
Figure 1B:
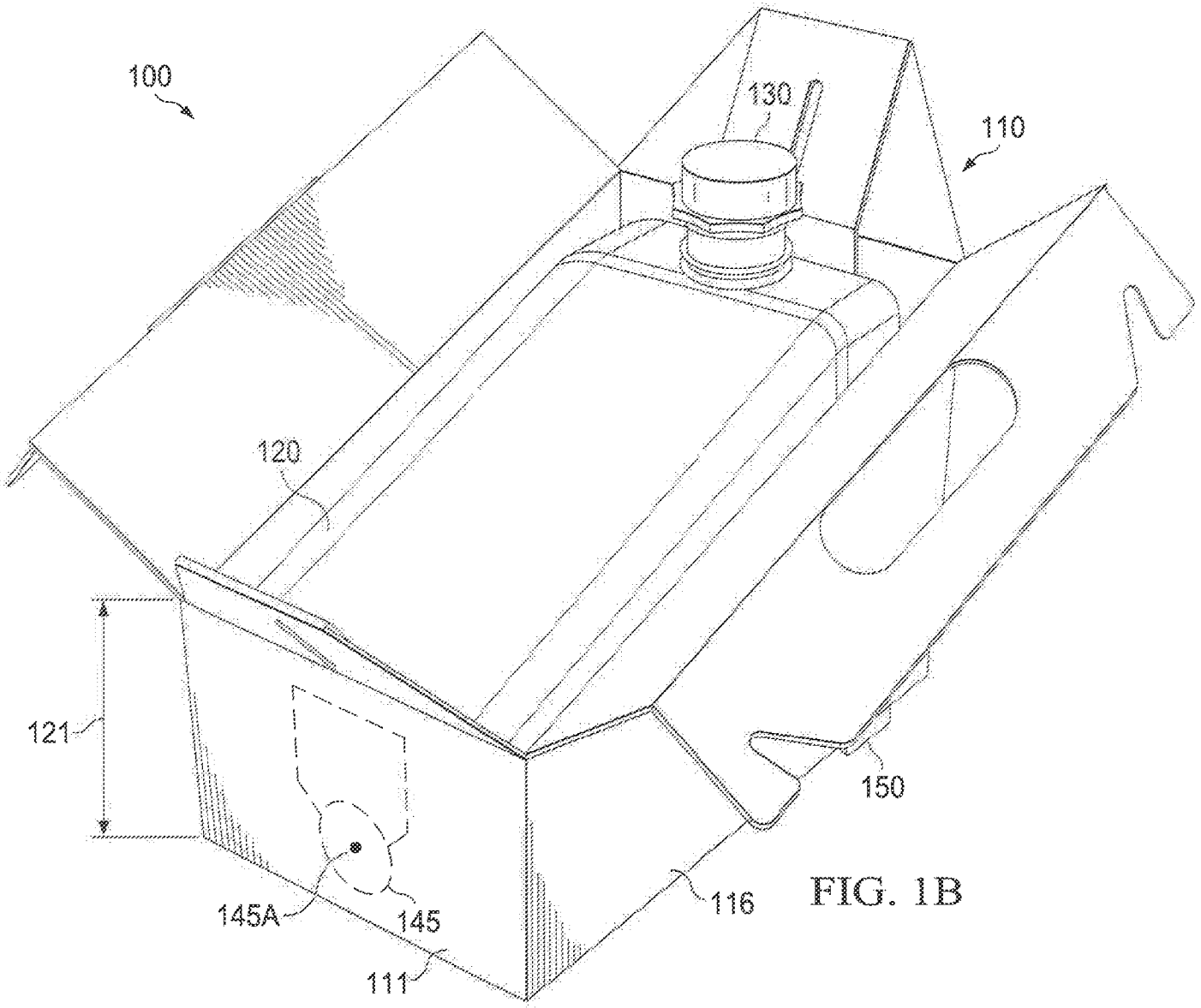
Figure 2:
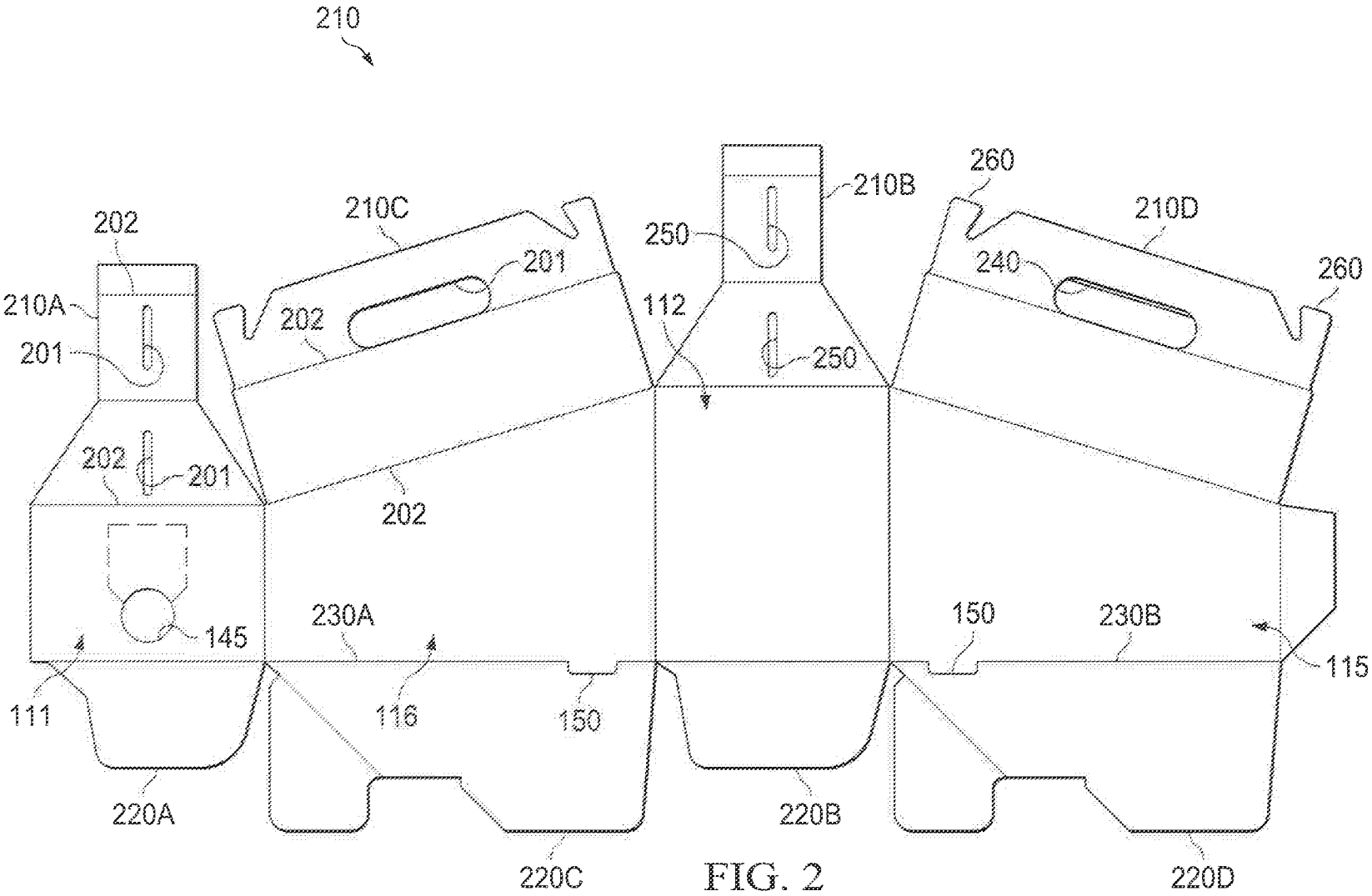
FIG. 2 illustrates a lay-flat box that may be used in the liquid carrier and dispensing system of FIG. 1, according to certain embodiments.
Figure 3:
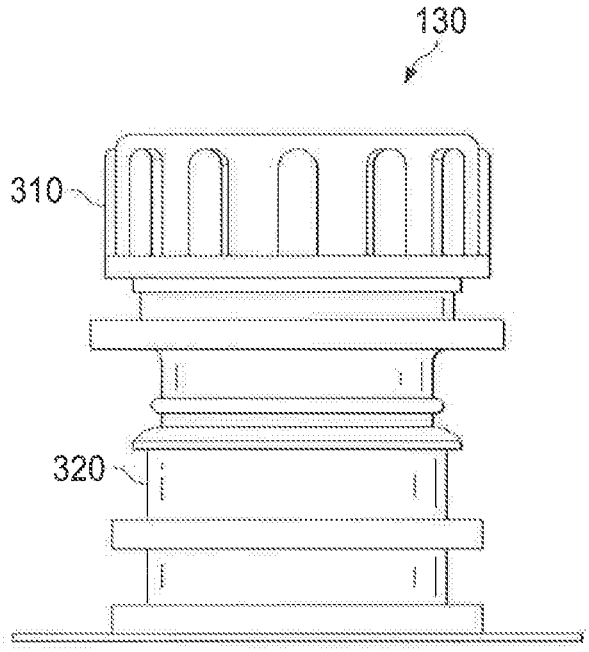
FIG. 3 illustrates a spout that may be used in the liquid carrier and dispensing system of FIG. 1, according to certain embodiments.
Figure 4:
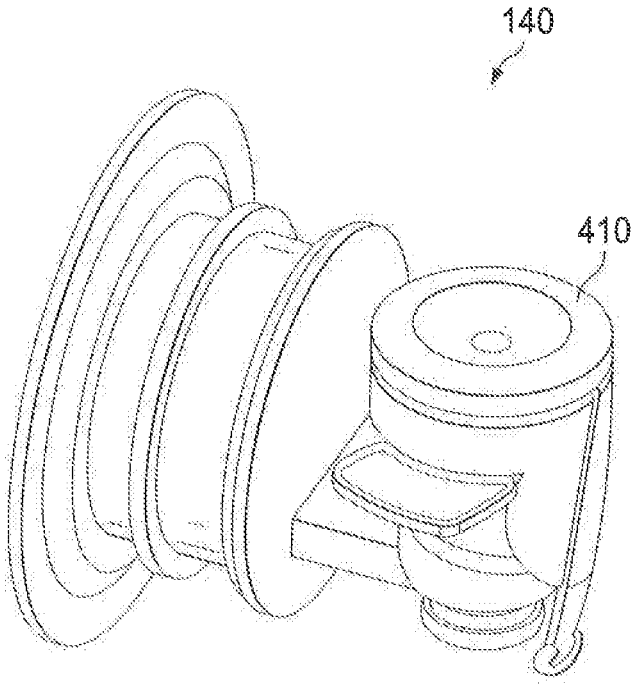
FIG. 4 illustrates a tap that may be used in the liquid carrier and dispensing system of FIG. 1, according to certain embodiments.

FIGS. 1A and 1B illustrate a liquid carrier and dispensing system, FIG. 2 illustrates a lay-flat box that may be used in the liquid carrier and dispensing system of FIG. 1, FIG. 3 illustrates a spout that may be used in the liquid carrier and dispensing system of FIG. 1, and FIG. 4 illustrates a tap that may be used in the liquid carrier and dispensing system of FIG. 1, according to certain embodiments.

FIGS. 1A and 1B illustrate a liquid carrier and dispensing system 100, according to certain embodiments. In some embodiments, liquid carrier and dispensing system 100 includes a box 110, a bag 120, a spout 130, and a tap 140. Spout 130 is coupled to bag 120 and permits liquid to be poured or otherwise loaded into bag 120. Spout 130 may also be coupled to bag 120 and permits the liquid inside bag 120 to be dispensed. Bag 120 may be placed inside box 110 as illustrated. In some embodiments, box 110 includes feet 150 and a handle 170. Box 110 permits liquid carrier and dispensing system 100 to be easily transported and for liquid to be easily dispensed from bag 120.

In general, liquid carrier and dispensing system 100 provides an inexpensive, quick and easy to assemble, easy to use, and an at least partially recyclable solution to carrying and dispensing bulk quantities of liquid such as coffee. Liquid carrier and dispensing system 100 includes various features that enable users to dispense liquid into a cup without having to lift and tilt box 110. More specifically, some embodiments include tap 140 that is located on a lower portion of one side of box 110 that permits liquid to be easily dispensed by only operating tap 140. This is in contrast to other systems that require users to remove a cap or lid and then lift the box in order to pour liquid into a cup. Furthermore, unlike other liquid dispensing systems, some embodiments of liquid carrier and dispensing system 100 are completely sealed after being filled with liquid (e.g., via spout 130) and do not have to be unsealed in order to dispense liquid out of bag 120. This prevents exposing liquid contents within bag 120 to the environment and therefore helps keep warm liquids such as coffee warmer and fresher longer than existing solutions.

Box 110 is generally any appropriate box or container for holding or containing bag 120. In some embodiments, box 110 is made of recyclable cardboard, paper, plastic, or any other appropriate material. In some embodiments, box 110 includes a front side 111, a back side 112 that is opposite front side 111, a top side 113, a bottom side 114 that is opposite top side 113, a left side 115, and a right side 116 that is opposite left side 115. In some embodiments, box 110 includes at least two feet 150 that protrude from bottom side 114 proximate to back side 112 and are configured to elevate back side 112 of box 110. This may help any liquid within bag 120 to exit bag 120 via tap 140. In some embodiments, box 110 may include handle 170 for transporting liquid carrier and dispensing system 100. As described in more detail below in reference to FIG. 2, some embodiments of box 110 may be configured to lay flat prior to being assembled. This may allow for easier shipment and storage of multiple boxes 110 prior to usage.

In some embodiments, box 110 has an assembled shape that is a cuboid or a rectangular cuboid. In some embodiments, box 110 has a shape that slopes towards front side 111 as illustrated in FIGS. 1A and 1B. In these embodiments, a height 122 of back side 112 is greater than a height 121 of front side 111. Furthermore, in embodiments where box 110 slopes towards front side 11, sides 111, 112, 113, and 114 are rectangles, and sides 115 and 116 are quadrilaterals. While specific shapes of box 110 have been described and illustrated, box 110 may have any appropriate shape and size.

Bag 120 is any appropriate container for holding a liquid within liquid carrier and dispensing system 100. In some embodiments, bag 120 is a collapsible bag. In some embodiments, bag 120 is made from any appropriate material such as plastic. In some embodiments, bag 120 is a 3 L bag of metalized film. In some embodiments, bag 120 has a shape that corresponds to a shape of box 110 so that it may snugly fit within box 110 when filled with liquid. For example, when box 110 has a shape that slopes towards front side 111 as illustrated in FIGS. 1A and 18, bag 120 may have a corresponding shape that slopes away from spout 130 and towards front side 111. In some embodiments, bag 120 is configured to be placed into box 110 through an opened top side 113 of box 110 so that spout 130 is located proximate to back side 112 and top side 113 of box 110 as illustrated in FIGS. 1A and 1B.

Spout 130 is any appropriate device that permits liquid to be poured or otherwise loaded into bag 120. A particular embodiment of spout 130 is illustrated in FIG. 3. In some embodiments, spout 130 includes a removable cap 310 and a stem 320. Removable cap 310 may be screwed or otherwise coupled onto stem in any appropriate manner. Stem 320 may be permanently affixed to bag 120 (e.g., bag 120 and stem 320 may be manufactured together) or may be affixed to bag 120 during assembly of liquid carrier and dispensing system 100. In general, removeable cap 310 may be removed from spout 130 to allow any appropriate liquid to be placed into bag 120. After bag 120 is filled with liquid, removeable cap 310 may be screwed or otherwise coupled back to spout 130 to protect the liquid inside bag 120 from the environment.

Tap 140 is any appropriate device for permitting liquid within bag 120 to be dispensed. In some embodiments, tap 140 is a VITOP tap. A specific embodiment of tap 140 is illustrated in FIG. 4. In general, tap 140 prevents exposing the liquid inside bag 120 to the environment while still permitting a user to dispense liquid into, for example, a cup. In some embodiments, tap 140 includes a handle 410 that may be pressed downward in order to dispense liquid from bag 120. In other embodiments, tap 140 may include any other appropriate mechanism (e.g., screw open/close) that permits liquid inside bag 120 to be dispensed. In some embodiments, tap 140 may be permanently affixed to bag 120 (e.g., bag 120 and tap 140 may be manufactured together). In other embodiments, tap 140 may be affixed to bag 120 during assembly of liquid carrier and dispensing system 100. In these embodiments, tap 140 may be placed through access hole 145 and then coupled to bag 120. Access hole 145 is described in more detail below. In some embodiments, tap 140 is located entirely below or at least partially below horizontal center line 160.

In some embodiments, box 110 includes an access hole 145 on one side. For example, access hole 145 may be located on front side 111. Access hole 145 is generally any aperture of any appropriate shape and size for accommodating tap 140. In some embodiments, access hole 145 may be a die-cut access hole that is round in shape. In some embodiments, access hole 145 is located entirely below or at least partially below horizontal center line 160. Horizontal center line 160 is generally a line that is in the middle of front side 111. That is, horizontal center line 160 is located in the middle of height 121 and splits front side 111 horizontally into two equal portions: an upper portion 111A and a lower portion 111B. In embodiments where access hole 145 is located entirely below horizontal center line 160, access hole 145 is completely below horizontal center line 160 in lower portion 111B of front side 111. In embodiments where access hole 145 is at least partially below horizontal center line 160, a portion of access hole 145 is above horizontal center line 160 (i.e., within upper portion 111A) and a portion of access hole 145 is below horizontal center line 160 (i.e., within lower portion 111B). In these embodiments, a center 145A of access hole 145 may be either above or below horizontal center line 160. In some embodiments, center 145A is below horizontal center line 160 such that the majority of the area of access hole 145 is within lower portion 111B of front side ill.

Feet 150 are any appropriate protrusions or devices that elevate back side 112 of liquid carrier and dispensing system 100. In general, feet 150 elevate liquid carrier and dispensing system 100 so that liquid in bag 120 may flow towards front side 11 and be easily dispensed from tap 140. Feet 150 may prevent a user from having to lift and tilt liquid carrier and dispensing system 100 in order to dispense liquid from tap 140. In some embodiments, liquid carrier and dispensing system 100 includes two feet 150 that are integrated into box 110 (e.g., as tabs). In some embodiments, feet 150 are located on bottom side 114 of box 110 proximate to back side 112, as illustrated. In some embodiments, feet 150 are any appropriate shape and size. For example, feet 150 may be rectangular in shape and approximately one inch in length. In some embodiments, feet 150 are any appropriate distance from back side 112. For example, feet 150 may be 0-1 inches from back side 112, 1-2 inches from back side 112, or 2-3 inches from back side 112.

Handle 170 is any appropriate shape and size that permits a user to transport liquid carrier and dispensing system 100. In some embodiments, handle 170 is formed from tabs of box 110 as illustrated in FIG. 2.

FIG. 2 illustrates a lay-flat box 210 that may be used as box 110 in liquid carrier and dispensing system 100, according to certain embodiments. In general, lay-flat box 210 may be cut from a single piece of material (e.g., cardboard) and may include multiple cutouts 201 and creases 202 that permit lay-flat box 210 to be assembled into box 110 of liquid carrier and dispensing system 100. Multiple lay-flat boxes 210 may be stacked on top of each other for more efficient storage and transport for customers of liquid carrier and dispensing system 100. In some embodiments, creases 202 may be lines that have been pre-folded, perforated, or partially cut (e.g., cut to a certain depth) that permit easy folding of lay-flat box 210 along creases 202. In some embodiments, lay-flat box 210 includes multiple tabs that, when assembled, form the sides of box 110. For example, some embodiments of lay-flat box 210 includes upper tabs 210 (e.g., 210A-D) that, when assembled, form top side 113 and handle 170 of liquid carrier and dispensing system 100. In these embodiments, tabs 210C-D include hand holes 240 for carrying box 110 and cutouts 260 that may be placed into slits 250 in tabs 210A-B for keeping top side 113 closed. Similarly, some embodiments include lower tabs 220 (e.g., 220A-D) that, when assembled, form bottom side 114 of box 110. In some embodiments, feet 150 may be formed by cutting lines 230A-B around feet 150 but leaving the remaining portions of lines 230A-B uncut as creases 202. This may permit lay-flat box 210 to be folded along lines 230A-B, thereby causing feet 150 to protrude from bottom side 114.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A liquid dispensing system, comprising:

a collapsible bag configured to be filled with a liquid, the collapsible bag comprising a spout, the spout configured to permit the liquid to be poured into the collapsible bag;

a tap configured to be coupled to the collapsible bag, the tap configured to permit the liquid to be dispensed out of the collapsible bag; and a box configured to contain the collapsible bag, the box comprising:

a back side;

a front side opposite the back side, the front side comprising an access hole for the tap, at least a portion of the access hole being located below a horizontal center line of the front side;

a left side;

a right side opposite the left side;

a bottom side;

a top side opposite the bottom side, the top side being sloped from the back side towards the front side such that the front side is shorter than the back side;

a handle configured for carrying the box, the handle located proximate to the top side of the box; and a plurality of feet located on the bottom side of the box proximate to the back side, the plurality of feet configured to elevate the back side of the box;

wherein:

the box is configured to enclose the spout of the collapsible bag within the box;

the collapsible bag comprises a first end and a second end that is opposite the first end;

the tap is configured to be coupled to the collapsible bag proximate the second end;

the spout is located on a top side of the collapsible bag proximate the first end; and the first end of the collapsible bag is taller than the second end of the collapsible bag such that the top side of the collapsible bag, when filled with liquid, slopes downward from the taller first end towards the shorter second end.

2. The liquid dispensing system of claim 1, wherein the box is configured to lay flat prior to assembly.

3. The liquid dispensing system of claim 1, wherein the collapsible bag is configured to be placed into the box so that the spout is located proximate to the back side and the top side of the box.

4. The liquid dispensing system of claim 1, wherein the box further comprises at least four tabs that, when assembled, form the top side and the handle of the box.

5. The liquid dispensing system of claim 1, wherein the collapsible bag, when filled with liquid, comprises a shape that corresponds to a shape of the box.

6. The liquid dispensing system of claim 1, wherein the access hole is located entirely below the horizontal center line of the front side of the box.

7. The liquid dispensing system of claim 1, wherein a center of the access hole is located below the horizontal center line of the front side of the box.

8. A liquid dispensing system, comprising:

a bag comprising a spout, the spout configured to permit the bag to be filled with a liquid;

a tap configured to be coupled to the bag; and a box configured to hold the bag, the box comprising:

a back side having a first height; and a front side opposite the back side, the front side having a second height that is less than the first height, the front side comprising an aperture for the tap, at least a portion of the aperture being located below a horizontal center line of the front side;

wherein:

the box is configured to enclose the spout of the bag within the box;

the bag comprises a first end and a second end that is opposite the first end;

the tap is configured to be coupled to the bag proximate the second end;

the spout is located on a top side of the bag proximate the first end; and the first end of the bag is taller than the second end of the bag such that the top side of the bag, when filled with liquid, slopes downward from the taller first end towards the shorter second end.

9. The liquid dispensing system of claim 8, wherein the box is configured to lay flat prior to assembly.

10. The liquid dispensing system of claim 8, wherein the bag is configured to be placed into the box so that the spout is located proximate to the back side of the box.

11. The liquid dispensing system of claim 8, wherein the box further comprises at least four tabs that, when assembled, form a handle of the box.

12. The liquid dispensing system of claim 8, wherein the bag, when filled with the liquid, comprises a shape that corresponds to a shape of the box.

13. The liquid dispensing system of claim 8, wherein the aperture is located entirely below the horizontal center line of the front side of the box.

14. The liquid dispensing system of claim 8, wherein a center of the aperture is located below the horizontal center line of the front side of the box.

15. A box for a liquid dispensing system, the box comprising:

a back side;

a front side opposite the back side, the front side comprising an access hole for a tap, at least a portion of the access hole being located below a horizontal center line of the front side;

a left side;

a right side opposite the left side;

a bottom side;

a top side opposite the bottom side, the top side being sloped from the back side towards the front side such that the front side is shorter than the back side, the top side configured to open and close in order to permit a bag to be placed into the box, the bag comprising a spout configured to permit the bag to be filled with a liquid, wherein:

the box is configured to enclose the spout of the bag within the box;

the bag comprises a first end and a second end that is opposite the first end;

the tap is configured to be coupled to the bag proximate the second end;

the spout is located on a top side of the bag proximate the first end; and the first end of the bag is taller than the second end of the bag such that the top side of the bag, when filled with liquid, slopes downward from the taller first end towards the shorter second end;

a handle configured for carrying the box, the handle located proximate to the top side of the box; and a plurality of feet located on the bottom side of the box proximate to the back side, the plurality of feet configured to elevate the back side of the box.

16. The box of claim 15, wherein the box further comprises at least four tabs that, when assembled, form the top side and the handle of the box.

17. The box of claim 15, wherein the box, when assembled, comprises a shape that corresponds to a shape of the bag when filled with the liquid.

18. The box of claim 15, wherein the access hole is located entirely below the horizontal center line of the front side of the box.

19. The box of claim 15, wherein a center of the access hole is located below the horizontal center line of the front side of the box.

* * * * *